US006945795B1

(12) United States Patent
Gross III et al.

(10) Patent No.: US 6,945,795 B1
(45) Date of Patent: Sep. 20, 2005

(54) QUADRAX INTERCONNECT GROUNDING

(75) Inventors: Russell Frederick Gross III, Riverside, CA (US); Peter Joseph Hyzin, Trabuco Canyon, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/009,264

(22) Filed: Dec. 9, 2004

(51) Int. Cl.[7] ..... H01R 4/66
(52) U.S. Cl. ..... 439/92; 439/63; 439/744
(58) Field of Search ..... 439/63, 92, 607, 439/744, 903, 108

(56) References Cited

U.S. PATENT DOCUMENTS

| | | | | |
|---|---|---|---|---|
| 4,950,170 | A * | 8/1990 | Miller, Jr. | 439/74 |
| 4,997,376 | A * | 3/1991 | Buck et al. | 439/59 |
| 6,144,561 | A * | 11/2000 | Cannella et al. | 361/796 |
| 6,712,648 | B2 * | 3/2004 | Padro et al. | 439/701 |
| 2002/0177332 | A1 * | 11/2002 | Hubbard et al. | 439/63 |

* cited by examiner

*Primary Examiner*—Hien Vu
(74) *Attorney, Agent, or Firm*—Roger C. Turner

(57) ABSTRACT

A quad interconnect system for receiving quad connectors and connecting their quad contacts to corresponding signal traces on a circuit board, provides a grounded electromagnetic shield around each quad connector in a simple arrangement that occupies a minimum amount of space on the circuit board. A housing with quad-receiving passages that receive the quad connectors, is constructed of metal to provide a grounded metal shield closely around each quad connector. Only a few grounding devices (less than half the number of quad-receiving passages) are used to connect the metal housing to a grounded trace on the circuit board, to minimize the space taken up on the circuit board. Sheet metal clips with tines that engage shoulders at the rear ends of flanges on each metal shell of a quad connector, have short tabs with edges that also engage the shoulders to assure good electrical connection and minimize vibration. Quad connectors can be used that do not have shells, but which are closely surrounded by smaller diameter grounded housing passage walls.

8 Claims, 4 Drawing Sheets

FIG. 1
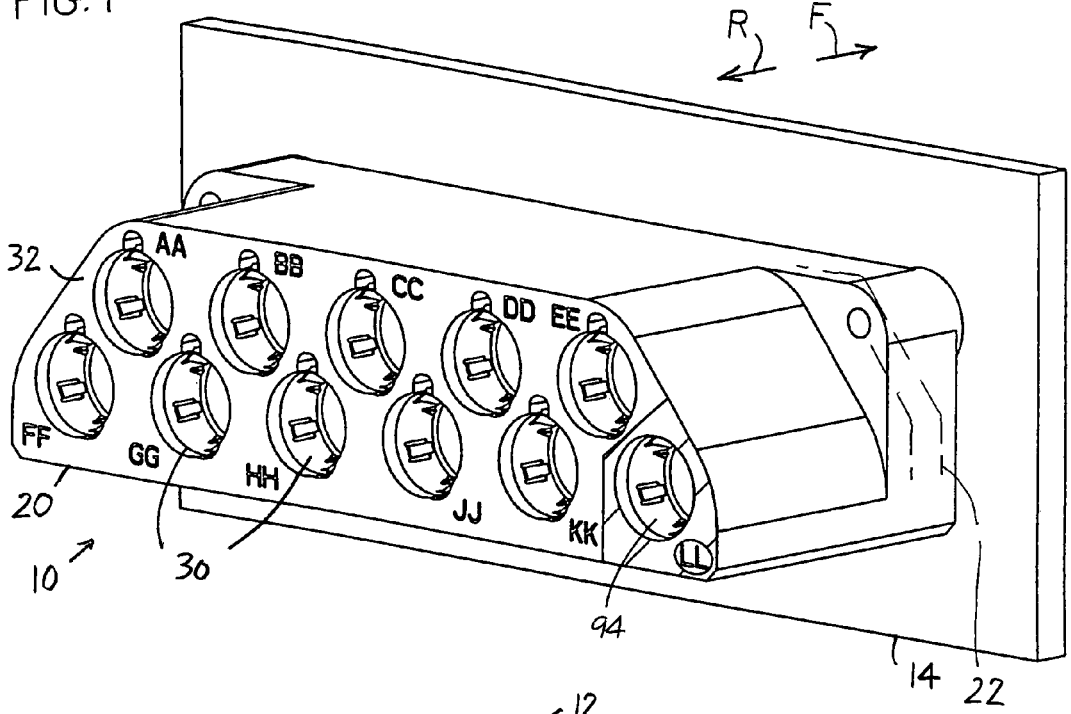
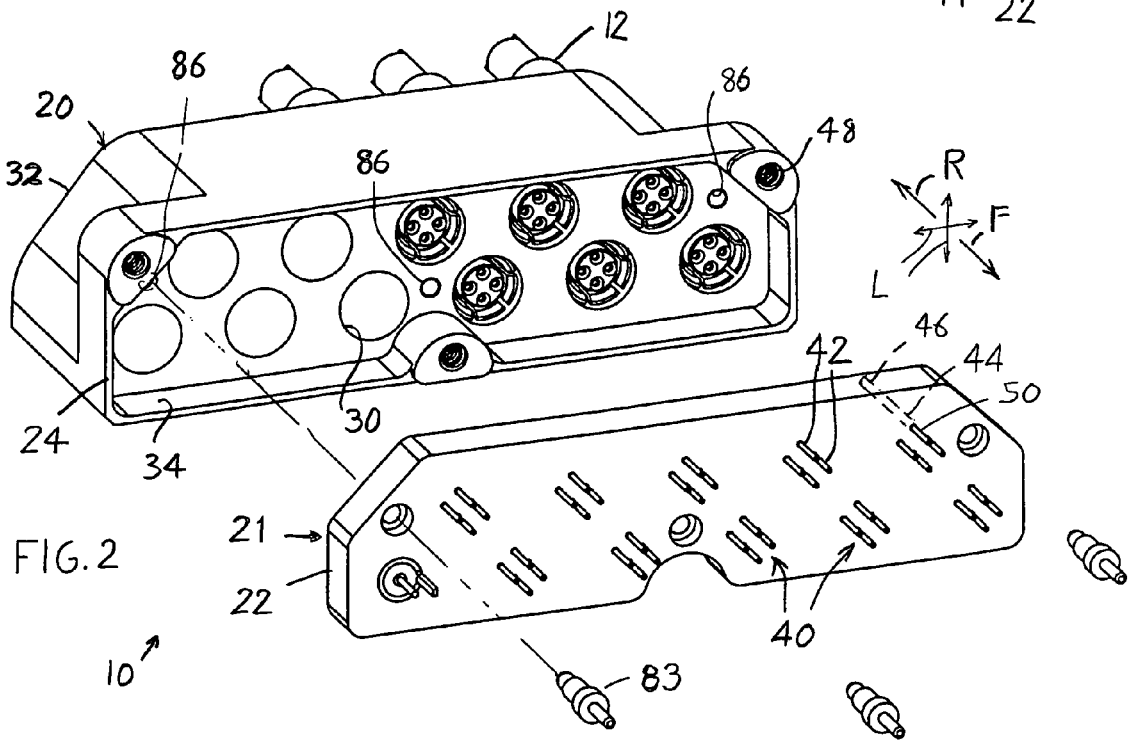
FIG. 2

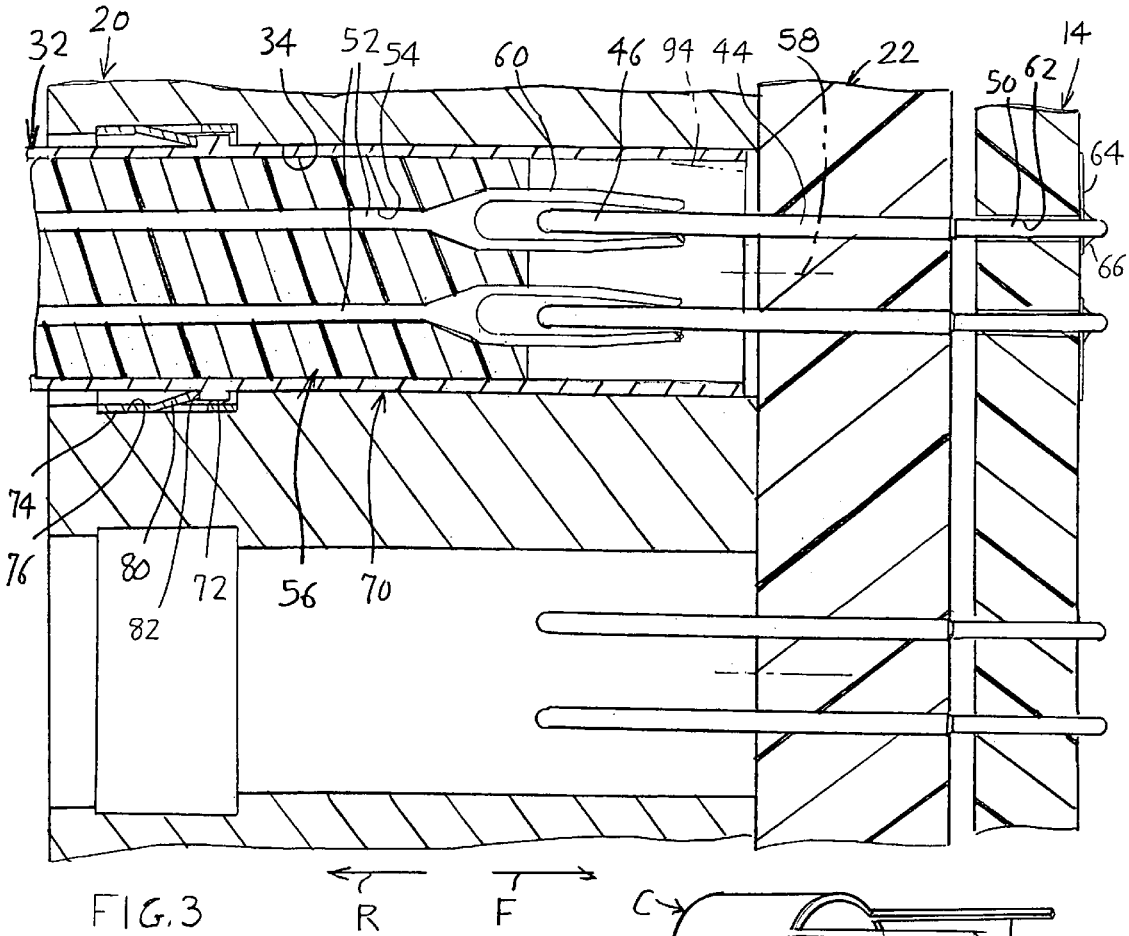
FIG. 3
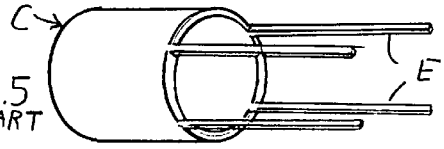
FIG. 5
OTHER ART
FIG. 4 OTHER ART
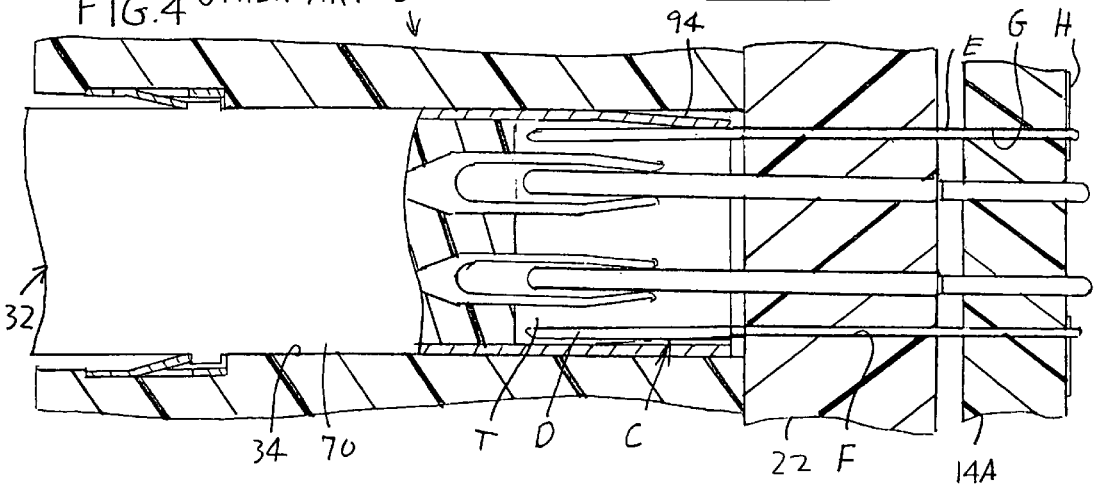

110

R F

QUADRAX INTERCONNECT GROUNDING

BACKGROUND OF THE INVENTION

Quad connectors are connectors that each has four quad contacts lying in a quad insulator, with the insulator usually surrounded by a metal shell. A group of such quad connectors can be terminated to a circuit board by the use of a quad interconnect assembly. Such a quad interconnect assembly has an insulative housing with many quad-receiving passages and an insulative plate with many interconnect pins. A quad connector is inserted forwardly into a passage until the front ends of its quad contacts connect to rear ends of four of the interconnect pins. The pins have front ends that project from the insulative plate and that can be inserted into signal holes in the circuit board and soldered thereat to signal traces on the circuit board.

Noise, which may arise from signals in the many close quad contacts and connectors, is reduced by connecting each quad shell to ground potential. This previously has been accomplished by use of a grounding element for each quad connector, which had a rear end lying at the rear of each passage and in contact with the rear of a quad shell in the passage. Each grounding element had a plurality of pins extending though and forward of the insulative plate, for insertion into grounding holes in the circuit board. Such grounding elements take up space not only at-the rear of each passage, but on the circuit board. This can result in the need for larger spacing between quad-receiving passages and a larger circuit board with more holes, which results in greater expense and a larger apparatus. A quad interconnect assembly of simpler and smaller design would be of value.

SUMMARY OF THE INVENTION

In accordance with one embodiment of the present invention, applicant provides a quad interconnect system for connecting contacts of each of many quad connectors to signal traces on a circuit board, while minimizing crosstalk noise by providing an electromagnetic shield closely around each quad connector, which minimizes the complexity of the circuit board and the complexity of the interconnect system. The interconnect system includes a housing with quad-receiving passages. Each passage has electrically conductive passage walls that are grounded. The grounded housing is connected to a grounded trace on the circuit board by one or more grounding devices that each has a rear end that engages walls of a hole in the housing that is laterally spaced from the passages. Each grounding device engages a grounding trace on the circuit board. There are fewer grounding devices than quad-receiving passages.

Where each quad connector has a metal shell around a quad insulator that holds four quad contacts, good electrical connection between the shell and the conductive housing is provided by a sheet metal clip that does double duty. The clip has the usual tines that engage a shoulder at the rear end of a shell flange. The clip also has short tabs with edges that are positioned to engage the shell flange to provide good electrical contact with the shell. The radially inward force of the tabs against the flange also minimizes vibration of the quad connectors.

Instead of using quad connectors with shells, the quad connectors can be provided without shells. In that case, the quad-receiving passages in the conductive housing can be made slightly smaller to closely surround the quad connector insulators, and no electrical connection is required between the walls of each passage and any shell of the quad connector. The quad connectors are then simpler, and the housing can hold quad connectors closer together for an even smaller housing and circuit board.

The novel features of the invention are set forth with particularity in the appended claims. The invention will be best understood from the following description when read in conjunction with the accompanying drawings.

BRIEF DESCRIPTION OF THE DRAWINGS

FIG. 1 is a rear isometric view of a quad interconnect system shown fully connected to a circuit board, but without any quad connectors shown.

FIG. 2 is an exploded front isometric view showing the housing and insulative plate of the interconnect system of FIG. 1, but without the circuit board, and with a few quad connectors lying in the housing.

FIG. 3 is a partial sectional view of the system of FIG. 1, including the circuit board fully installed, and showing a quad connector fully installed in one of the housing passages and with its quad contacts connected to circuit board signal traces.

FIG. 4 is a sectional view similar to that of FIG. 3, but of a connector system of other art that applicant previously used.

FIG. 5 is an isometric view of a grounding device of the other art of FIG. 4.

DESCRIPTION OF THE PREFERRED EMBODIMENTS

Figure 6:
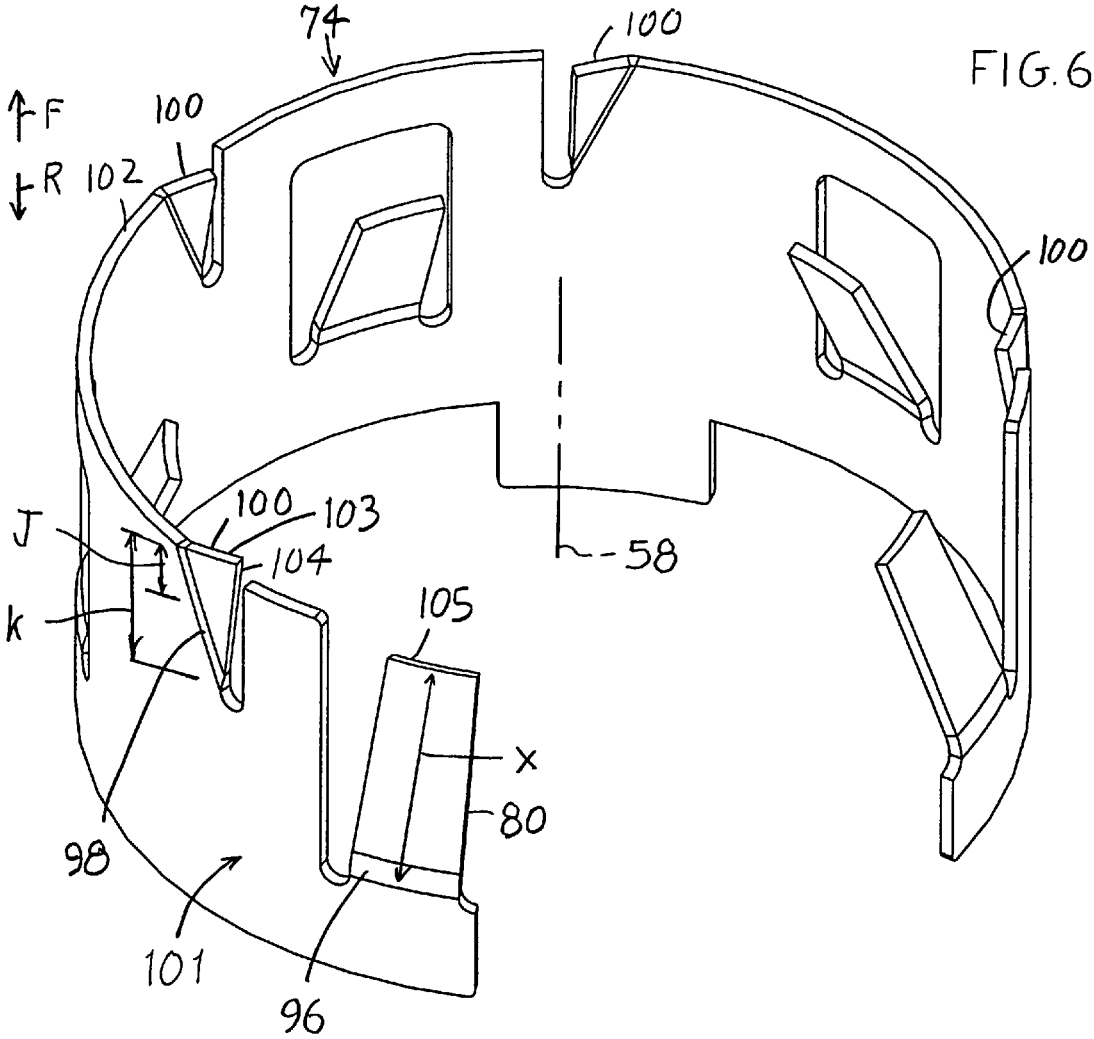
FIG. 6 is an enlarged isometric view of a clip of the system of FIG. 3.

FIGS. 1 and 2 show a quad interconnect system 10 that can receive quad connectors 12 and connect them to traces on a circuit board 14. The quad 25 interconnect system includes a housing 20 a header assembly 21 that includes an insulative plate 22 that is attached to the front 24 of the housing. The housing has a plurality of quad-receiving passages 30. A quad connector 12 is installed by inserting it forwardly F into the rear end 31 of the housing. The Insulative plate 22, which mounts in a recess 33 (that may be divided into recess parts that each holds an insulative plate part) at the front of the housing, holds groups 40 of pins 42. The pins have middle portions 44 fixed in the plate, rear portions 46 that project rearward R from the plate to mate with contacts of quad connectors, and front portions 50 that project forwardly from the plate and are intended to fit into holes in the circuit board. Three threaded holes 48 in the housing receive screws that fix the housing on the circuit board.

FIG. 3 shows a quad connector 32 lying in a passage 34 of the housing 20 and centered on the axis 58 of the passage. The quad connector has four quad contacts 52 each lying in one of four bores 54 of a quad insulator 56. Only two contacts of each group of four is shown in FIG. 3. The front end 60 of each quad contact shown in FIG. 3 is a socket, and each pin rear end 46 is shown mated to the contact. Each pin front end 50 lies in a signal hole 62 of the circuit board 14.

The circuit board has a signal trace 64 lying about each signal hole, and preferably also-plating the walls of the signal hole. The pin front end, or front end portion, is preferable joined by a solder joint 66 to a trace.

The quad connector 32 is shown with a metal shell 70 lying around the insulator. The shell has a flange 72. A releasable clip 74 lies in a recess 76 of each housing passage and has deflectable tines 80 that engage a rearwardly-facing shoulder 82 of the shell flange. The tines can be deflected radially outwardly by a tool to pull the quad connector rearwardly out of the passage.

Figure 8:
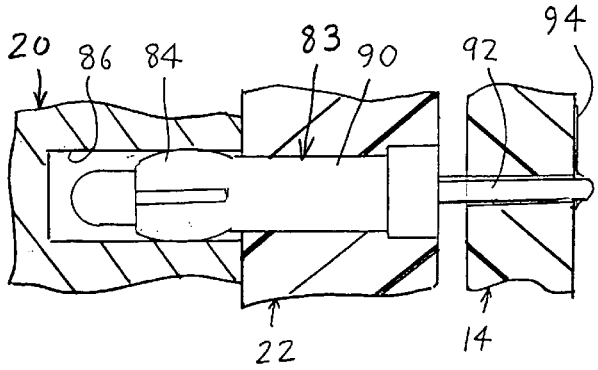
FIG. 8 is a sectional view of a portion of the connector system of FIG. 2, showing one of the grounding devices fully installed in the housing and in the circuit board.

In order to reduce electronic noise on each quad contact 52, the quad shell 70 should be grounded, that is, electrically connected to ground, to provide an electromagnetic shield around each set of four contacts. In accordance with the present invention, applicant eases the grounding of the quad shells by forming the housing 20 of electrically conductive material. The electrically conductive material lies at least at the walls of the quad-receiving passages 34, and the walls of the quad-receiving passages are all connected together and to a ground potential provided by the circuit board. It is possible to metal plate an insulative material, but applicant prefers to use a solid metal housing, i.e. one formed completely of metal. FIG. 8 shows a grounding device 83 that is used to connect the conductive housing 20 to a ground trace 94 on the circuit board. The grounding device has a rear part 84 with resilient beams that lie in a grounding hole 86 of the housing, a middle part 90 anchored in the insulative plate, and a front part 92 that is connected to a ground trace 94 on the circuit board. The ground device can be solid and press fit in the grounding hole.

While FIGS. 1 and 2 show that the housing 20 has ten quad receiving passages (and one coax receiving passage 94), FIG. 2 shows that the housing has only three grounding holes 86. The grounding holes 86 are laterally spaced from the quad-receiving passages. That is, the grounding holes are spaced from the passages in directions L that are perpendicular to the front and rear directions F, R.

Figure 7:
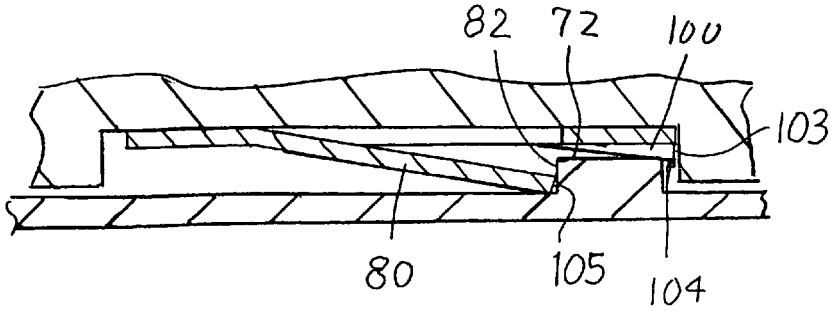
FIG. 7 is an enlarged sectional view of a portion of the system of FIG. 3.

Although the tines 80 of the clip 74 shown in FIG. 3 engage the quad connector shell to ground it, the connection can be intermittent and the light force of the tines against the shell can result in a high resistance connection and quad connector rattling. To achieve a lower resistant electrical connection, applicant forms the clip as shown in FIG. 6 with at least three short tabs 100 at the front end 102 of each clip. Both the tines 80 and tabs 100 merge at bends 96, 98 with a cylindrical main portion 101 of the clip. As shown in FIG. 7, the tabs 100 have tab front ends 103 lying forward of the tine front ends 105. The tabs have edges 104 that engage the rear flange 72 of the shell. The tabs press radially inwardly (with respect to the passage axis) against the flange. The average length J of each tab, and the total length K of each tab, is less that the length X of each tine 80, and is preferably less than half the tine length to achieve considerable pressing force. FIG. 7 show a tab 100 with its edge 104 pressing against the flange and biting into the flange. The fact that the flange 72 is thicker than the rest of the shell minimizes the harm from such biting. The tines 80 press radially inward with small forces. The larger force of the tabs against the flanges provide a better mechanical connection that helps to avoid rattling, or vibration of the quad connectors in the housing, in addition to low resistance contact.

FIG. 4 shows a quad interconnect system B that applicant earlier used to connect a quad connector 32 to traces on a circuit board 14A. The quad connector shell 70 was grounded by a grounding element C that had a cylindrical rear part D that fitted into a housing quad-receiving passage, and into a passage T in the front end of the shell. The shell front end had a plurality of resilient fingers 94 that engaged the rear part D of the grounding element. FIG. 5 shows that the grounding element had four pin-like front ends E that each passed though a hole F in the insulative plate 22 and into a hole G in the circuit board. Each pin front part was soldered to a grounded conductive trace H on the circuit board. Even if each grounding element C had only one pin-like front end, it would require grounding trace holes close to each set of four signal traces, and make the circuit board more complex. Applicant's use of fewer grounding devices, preferably less than half as many as the number of quad-holding passages, and the fact that the front ends of the grounding devices do not lie very close to the signal holes, results in a simpler housing and circuit board. In fact, the quad-receiving passages can be made to lie closer together.

Figure 9:
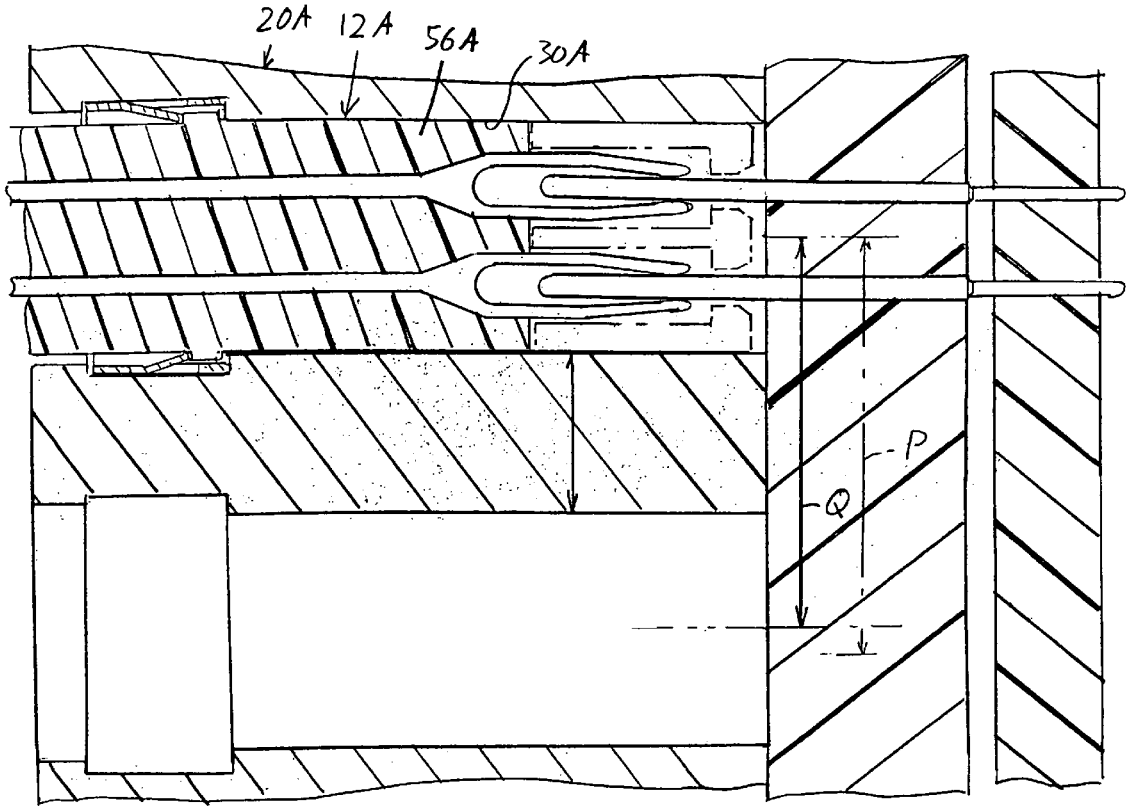
FIG. 9 is a sectional view of another embodiment of the invention, wherein quad connectors without shells are installed in a housing.

FIG. 9 shows another system 110, wherein each quad connector 12A has a quad connector insulator 56A that is not surrounded by a shell. The housing 20A is of electrically conductive material (at least at the passage walls) and the passages 30A closely receive the quad connector insulator. A typical quad connector insulator has an outer diameter of 4.4 millimeter along most of its length. The shell has a shell thickness of 0.55 mm. The passage inside radius should be no more than 0.5 mm greater than the insulator diameter to provide a close fit, and the difference is preferably less than 0.25 mm. With such a close fit, the grounded housing passage walls serve as an effective electromagnetic barrier that reduces noise on the signal contacts. FIG. 9 shows the distance between center of adjacent passages reduced from the distance P to the distance Q just because there is no shell in each quad connector. The distance can be reduced further because the circuit board is not as cluttered with grounding holes.

Thus, the invention provides a quad interconnect system which reduces the complexity of a circuit board around each set of four signal traces, which assures good grounding and reduced vibration of a quad connector shell, and which reduces the number and complexity of grounding devices. The housing that forms quad-receiving passages has electrically conductive passage walls that are connected together, as by making the entire housing of metal. The passage walls are connected to the quad connector shell. As a result, only the housing has to be grounded, which can be achieved using a minimum number of grounding devices and a simplified circuit board. Good electrical connection of a quad connector shell to the housing passage walls is achieved using the same clip that releasable retains the quad connector in a passage. The clip is provided with short clip tabs at its front end, that have edges that press forcefully against a flange on the shell. The quad connectors can be formed without a shell, and with smaller diameter passages that closely receive the quad connector to provide an effective electromagnetic shield around the connector.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An interconnect system for receiving quad connectors wherein each quad connector has a quad insulator with four bores that each holds a quad contact with a mating front end, the system including a header assembly that includes groups of four contact pins each group of the pins have pin middle portions fixed in an insulative plate, pin rear ends that project rearward of said insulative plate and that mate with the four quad contacts, and pin front ends that are mateable to signal traces on a circuit board that lies forward of the insulative plate and that has at least one ground trace, wherein the connector system includes a housing formed of conductive material with a plurality of laterally-spaced quad-holding passages, each of the laterally-spaced passages having a metal shell for holding one of said quad connectors and providing a grounded shield around the quad connector, wherein:

said housing passages have metal passage walls that are electrically connected together; and including at least one grounding device that has a rear device part electrically connected to metal of said housing, said grounding device part being laterally spaced from said quad-holding passages, said grounding device having a middle device part lying in said insulative plate and a front device part that is connectable to the ground trace of said circuit board.

2. The system described in claim 1 including said circuit board, and wherein:

said circuit board has a plurality of signal holes and signal traces each lying around one of said signal holes, and said circuit board has a ground hole and a ground trace lying around said ground hole;

said pin front ends each projects into one of said signal holes and is soldered to one of said signal traces;

said front device part of said grounding device projects through said ground hole and is soldered to said ground trace.

3. The system described in claim 1 wherein said metal shell with a rear flange forming a rearwardly-facing shell shoulder, and including at least one releasable sheet metal retainer clip which lies in said housing and that has a main portion and at least one tine with a tine front end that engages one of said shell shoulders to prevent rearward movement of a quad connector out of a housing passage, wherein:

said clip has at least one tab with a front end lying forward of said tine front end, said tab connected by a bend to said main portion, said tab being shorter than said tine and said tab has a sheet metal edge that bears against a location on said rear flange which is forward of said shell shoulder, to thereby provide a better electrical and mechanical connection between said shell and said housing.

4. The system described in claim 1 including a releasable clip lying in each of said passages, and wherein:

the insulator of each of said quad connectors has a cylindrical portion lying in one of said passages and has a flange forming a rearwardly-facing shoulder, and at least one of said tines of said clips engages each shoulder to hold the corresponding quad connector from falling rearwardly out of the corresponding passage;

each of said passages being of a diameter to closely receive the cylindrical portion of a corresponding one of said insulators.

5. The system described in claim 1 wherein:

said housing has a first number of said quad-holding passages, and has a second number of grounding holes that each receives the front device part of one of said grounding device;

said first number of passages is at least twice said second number of grounding holes.

6. A connector system for connecting to quad connectors comprising:

a housing with a plurality of laterally-spaced quad-holding through passages each having a metal shell;

a header assembly comprising an insulative plate formed of at least one plate part and mounted on a front end of said housing, said plate having a plurality of through pin holes and said header assembly including a plurality of pin contacts each projecting through said plate, each pin contact having rear portions projecting rearward of said plate and into one of said passages, and having a front portion projecting forward of said plate;

a circuit board lying forward of said insulative plate and having a plurality of signal holes and a signal trace lying around each signal hole, said pin contact front portions each projecting into one of said signal holes and soldered thereto;

said housing is formed of electrically conductive material with walls of said quad-holding passages each being electrically conductive and electrically connected together;

said circuit board has a ground trace, said housing has at least one housing ground hole laterally spaced from said quad-receiving passages, said insulative plate having a plate ground hole aligned with said ground hole in said housing, and said circuit board having a board ground hole and a grounded trace lying around said board ground hole; and including a grounding device extending through said plate ground hole, said grounding device having a front-end lying in and connected to said board ground hole and having a rear end lying in and connected to said housing ground hole.

7. The system described in claim 6 wherein:

the number of said quad-holding passages in said housing is at least twice the number of said housing ground holes in said housing.

8. The system described in claim 6 wherein each quad connector has a rearwardly-facing shoulder, and including:

a plurality of clips that each lies in one of said quad-holding passages;

each clip has a plurality of tines with front tips that abut the shoulder of a quad connector, and each clip has a plurality of tabs with front ends lying forward of said tine front tips and bearing against said shoulder.

* * * * *